US005666432A

United States Patent [19]

Izumisawa

[11] Patent Number: 5,666,432

[45] Date of Patent: Sep. 9, 1997

[54] APPARATUS FOR AND METHOD OF SOUND RECORDING IN ELECTRONIC SOUND CONTROL SYSTEM

[75] Inventor: Gen Izumisawa, Hamamatsu, Japan

[73] Assignee: Kawai Musical Inst. Mfg. Co., Ltd., Shizuoka, Japan

[21] Appl. No.: 198,388

[22] Filed: Feb. 18, 1994

Related U.S. Application Data

[63] Continuation of Ser. No. 929,571, Aug. 14, 1992, abandoned.

[30] Foreign Application Priority Data

Aug. 14, 1991 [JP] Japan ..... 3-204405

[51] Int. Cl.[6] ..... G10H 1/00

[52] U.S. Cl. ..... 381/118; 84/603; 84/627

[58] Field of Search ..... 84/627, 603; 381/118, 381/61

[56] References Cited

U.S. PATENT DOCUMENTS 4,182,210 1/1980 Nishimoto ..... 84/627

5,074,181 12/1991 Kitamura ..... 84/627

OTHER PUBLICATIONS

Scacciaferro et al, Casio FZ–1& FZ–10M, 1988, pp. 20, 57, 67–73, 96–99.

Casio, Digital Sampling Synthesizer FZ–1, 1988 (pre), pp. 23, 63–67, 132.

"Operation Manual" for Casio FZ–1 Digital Sampling Synthesizer, Casio, 1988 (pre 1988).

"The Essential Guide to Practical Applications" for Casio FZ–1 and FZ–10M Digital Sampling Synthesizer, by Joe Scacciaferro and Steve DeFuria, Hal Leonard, 1988.

"CSpeech Core User's Manual, CSpeech Version 3.1" by Paul H. Milenkovic and Charles Read, University of WI, 1986, 1990.

*Primary Examiner*—Forester W. Isen

[57] ABSTRACT

A start portion of sampled sound data is cleared, and the resultant sound data free from the start portion is modified into data increasing gradually from level "0". Thus, noise in the start portion of the recorded sound data is removed, and also sound data gradually increasing from level "0" at the start can be obtained, that is, a discontinuous point after the noise removal is precluded.

18 Claims, 5 Drawing Sheets

APPARATUS FOR AND METHOD OF SOUND RECORDING IN ELECTRONIC SOUND CONTROL SYSTEM

This application is a continuation of application Ser. No. 07/929,571 filed on Aug. 14, 1992, now abandoned.

BACKGROUND OF THE INVENTION

1. Field of the Invention

The present invention relates to an apparatus for and a method of sound recording for an electronic sound control system.

2. Description of the Related Art

In a prior art apparatus for and method of sound recording in an electronic musical instrument, natural sound, such as acoustic piano sound, as opposed to electrically generated sound, is collected using a microphone, sampled and digitally converted for recording, and the recorded sound data is reproduced as sound of an electronic musical instrument. Such sampling recording is possible for musical instruments other than the Piano, sounds other than musical instruments, and cries and calls of animals.

However, such sampling recorded sound data may contain noise or sounds other than the intrinsic sound data and is particularly likely to contain noise near the sound start point.

The invention solves the above problem, and its first object is to remove such noise in the start portion of sound and in order to realize improved musical sound.

In another aspect, when noise in the start portion of sound is removed in the above manner, a discontinuous point is formed, at which the start portion of the sound data suddenly rises from "0" to a certain level, as shown in (2) in FIG. 6. If this sound data is reproduced directly, noise is generated at the discontinuous point. Such noise can be precluded by timing the noise removal at the zero-crossing point of the sound data. To execute such process, however, is difficult. If a noise removal portion of sound data is timed at the zero-crossing point of sound data, some noise often remains without being clearly removed.

The invention thus seeks to Solve this problem, and its second object is to remove noise, which is generated when the noise in the start portion of sound data is removed, in order to realize improved musical sound.

SUMMARY OF THE INVENTION

According to the invention, input sound data is sampled for recording, a start portion of the recorded sound data is cleared, and the portion following the start portion is modified such that its level is increased gradually from level "0". Thus, noise in the first portion of the recorded sound data is removed, and also the sound data start portion level is gradually increased from level "0" and free from any discontinuous point after the noise removal.

DETAILED DESCRIPTION OF THE PREFERRED EMBODIMENT

Summary of the Embodiment

Figure 1:
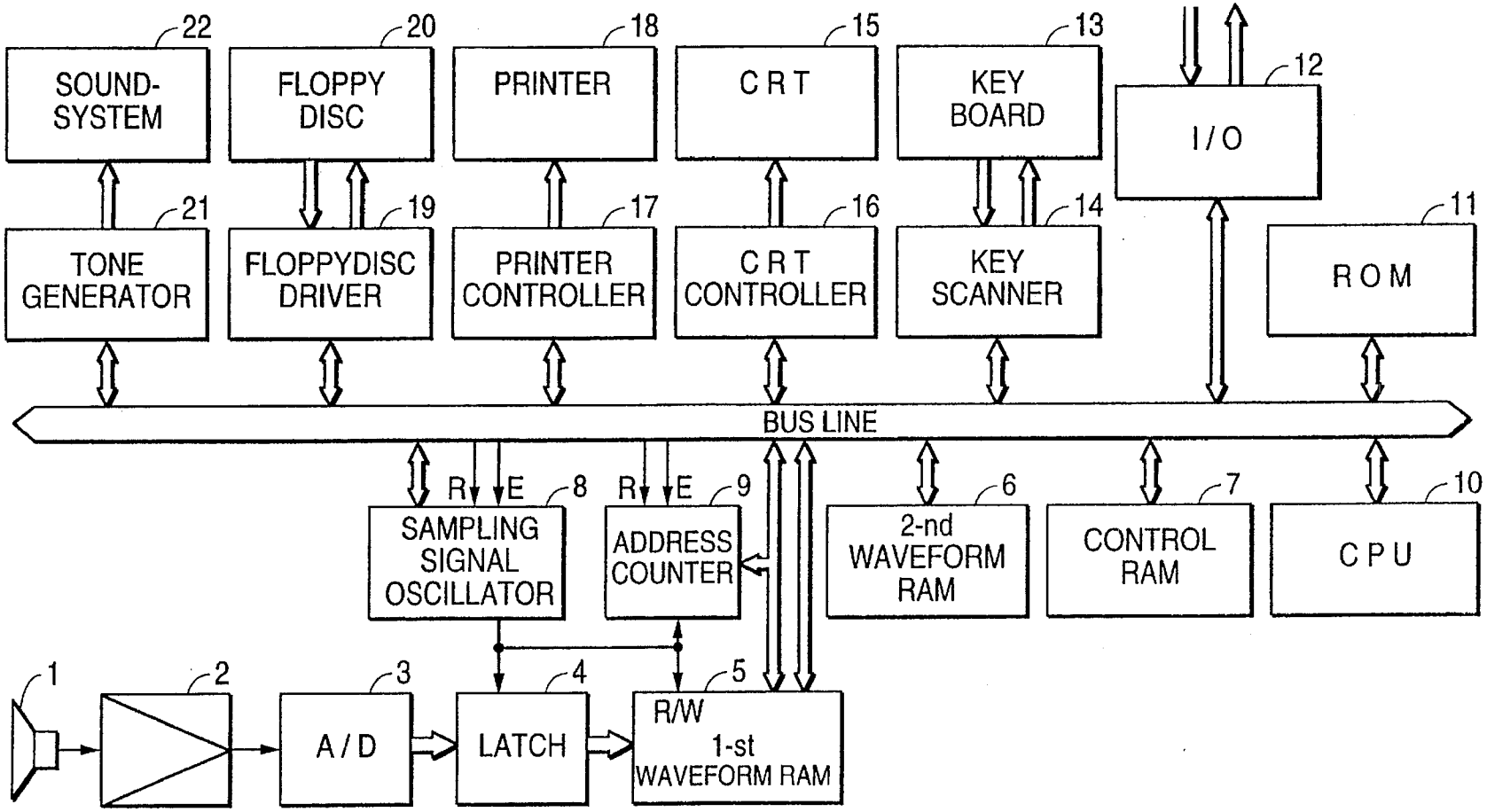
FIG. 1 is a block diagram showing the overall circuit of a sound recording and modifying system.

Sound data SD sampling recorded in first waveform RAM 5 is cleared from the start to a clear point CP (steps 11 through 15), thus removing noise in the start portion. The remaining portion of the sound data SD subsequent to the clear point CP is modified by multiplication with envelope data EN with the level thereof gradually increasing from "0" (steps 21 through 28), thus precluding the discontinuity at the clear point CP to obtain a noise-free clear sound waveform. The process of the steps 21 through 28 may be omitted if the clear point CP is a zero-crossing point of the sound data SD.

1. Overall Circuit

FIG. 1 shows the overall circuit of a sound recording and modifying system. A microphone 1 collects sound to be recorded and Converts the sound into an electric signal, i.e., a sound signal. This sound signal SS is amplified by an amplifier 2 and then converted in an A/D converter 3 into digital data, which is latched in a latch 4 and written successively in a first waveform RAM 5.

A sampling signal oscillator 8, which is a programmable oscillator, generates a sampling signal SP having a frequency corresponding to data set by a CPU 10, and this sampling signal SP is supplied as a latch signal to the latch 4. The sound signal SS is thus sampled at the frequency of the sampling signal SP. The sampling signal oscillator 8 may be a programmable frequency divider, timer or equivalent device.

The sampling signal SP from the sampling signal oscillator 8 is supplied as read/write command signal R/W to the first waveform RAM 5 to write data therein in synchronism with the sampling signal SP. The sampling signal SP is further input to an address counter 9 to count address data of the first waveform RAM 5. The sampling signal oscillator 8 and address counter 9 are reset and enabled or disabled switched by the CPU 10.

Figure 3:
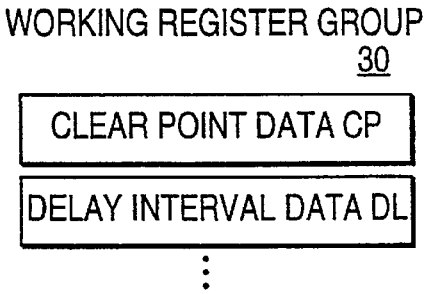
FIG. 3 is a view showing a working register group 30 in the control RAM.

The sound data SD recorded in the first waveform RAM 5 is subject to removal of noise data NS in a start portion and then multiplied with modifying data, which rises gradually from level "0", thus generating modified sound data MS. The modified sound data MS is stored in a second waveform RAM 6, and is used as a sound source of an electronic musical instrument. A plurality of different envelope data EN and other process data are stored in a control RAM 7, which includes a working register group 30 (FIG. 3). The envelope data EN may also be stored in a ROM 11. Still further, the first and second waveform RAMs 5 and 6 and control RAM 7 may be a single RAM. In the ROM 11 or the control RAM 7 are stored programs, which correspond to flow charts to be described later and executed by the CPU 10, and programs of other processes.

Various data are transmitted and received between an interface 12 and various apparatus such as an electronic musical instrument connected to the sound recording and correcting system. This data includes the sound data SD, modified sound data MS and envelope data EN noted above. The sound data SD, modified sound data MS, envelope data and various other data, commands and the programs noted above, are displayed on a CRT 15 via a CRT controller 16 or printed on a printer 18 via a printer controller 17. Further, this data is saved or loaded on a floppy disc 20 via a floppy disc driver 19.

Input, including numerals, letters, symbols, and commands are input at keyboard 13. The individual keys in the keyboard 13 are scanned by a key scanner 14. As a result, on/off data are detected and written in the control RAM 7 by the CPU 10. Thus, an "on" or "off" event is detected for each key. A tone generator 21 generates a sound signal corresponding to sound information supplied from the CPU 10, the sound signal is output by a sounding system 22. The sound information includes the sound data SD, modified sound data MS, envelope data EN, etc. The tone generator 21 may be a clock oscillator. The sounding system 22 may be a piezoelectric loudspeaker.

2. Envelope Data EN

Figure 2:
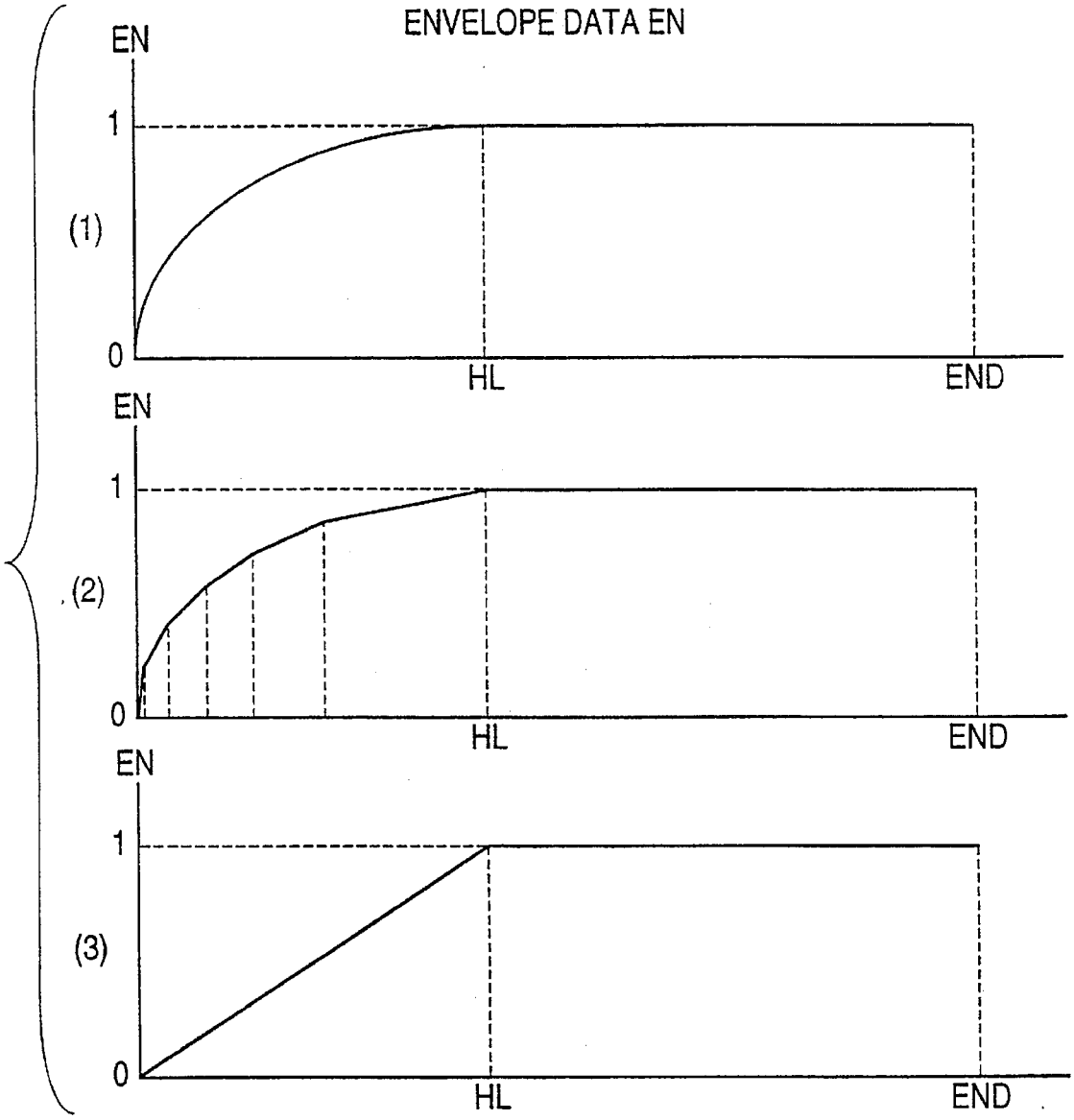
FIG. 2 is a view showing envelope data EN stored in a control RAM.

FIG. 2 shows the envelope data EN stored in the control RAM 7. The envelope data EN is multiplied with the sound data SD, as shown in (2) to (3) in FIG. 6, to eliminate a discontinuous point, at which a start portion of the sound data SD suddenly rises from "0" to a certain level. This envelope data EN has a waveform with a level gradually increasing exponentially from "0" and, upon reaching "1", held at this level "1".

The envelope data EN stored in the control RAM 7 is shown in (1) in FIG. 2. However, it is possible to store the data shown in (2) or (3) in FIG. 2. In case of envelope data EN which is held at level "1", once the level "1" is reached, only a portion from the start to a hold point HL, at which the level "1" is reached, may be stored in the control RAM 7. The hold level of the envelope data EN may be other than "1" or "0".

3. Working Register Group 30

Figure 6:
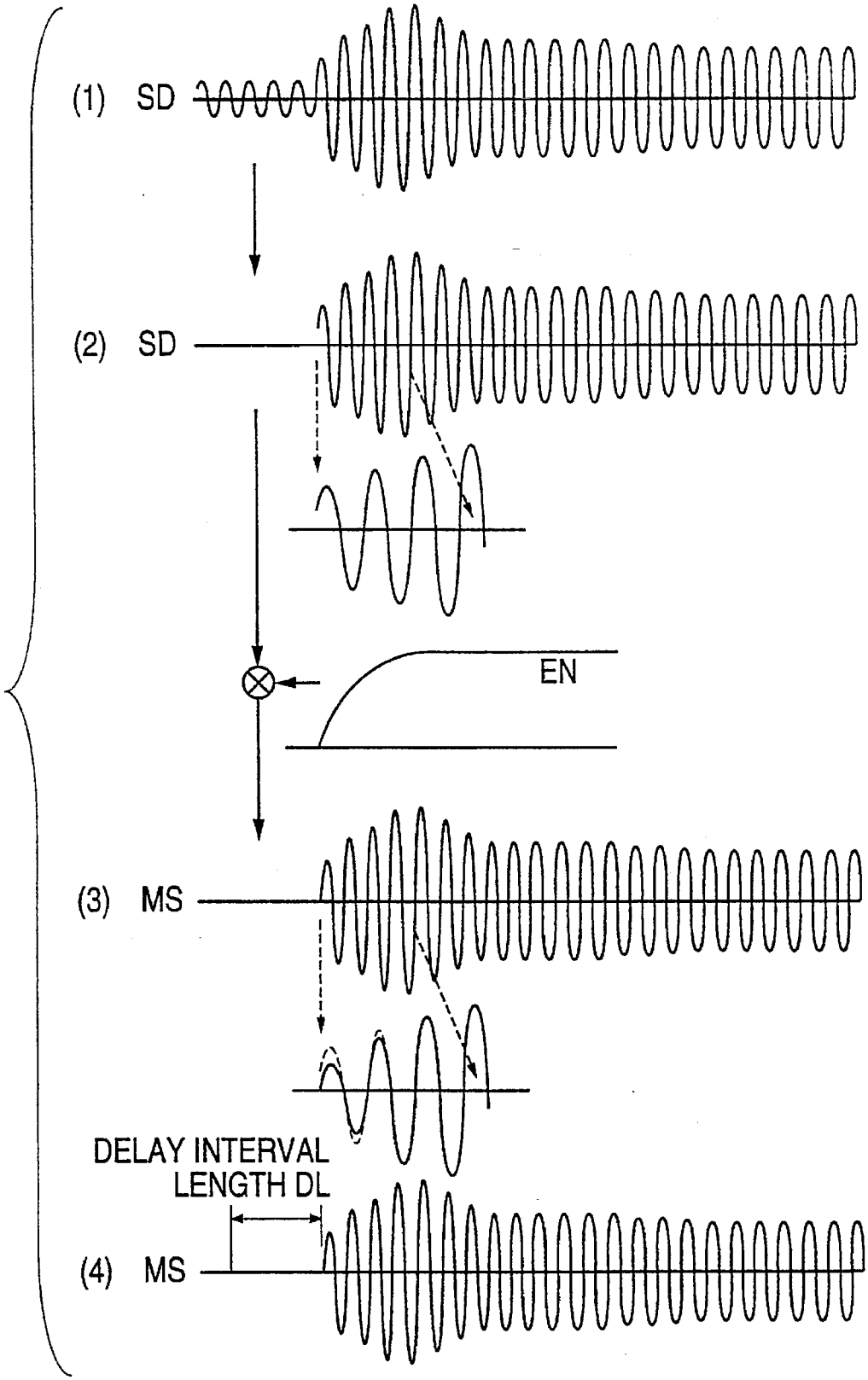
FIG. 6 is a a view illustrating a step of storing and modifying the sound signal SS.

FIG. 3 shows the working register group 30. In this working data register 30 are stored clear point data CP, delay interval data DL, etc. The clear point data CP, as shown in (1) and (2) in FIG. 6, shows an end address data of the portion of the sound data SD other than the noise data NS of the start portion. The portion of the sound data SD before the clear point CP is cleared.

The delay interval data DL shows an address number of data level "0", which is provided in the start portion of the modified sound data MS, obtained by the multiplying by the envelope data EN. With this data level at "0", stereo control can be effected. The stereo control is disclosed in the specification of U.S. Ser. No. 07/813,933, now U.S. Pat. No. 5,478,968. The clear point data CP and delay interval data DL are input to the keyboard 13 and written in the working register group 30 by the CPU 10.

4. Waveform Recording Process

Figure 4:
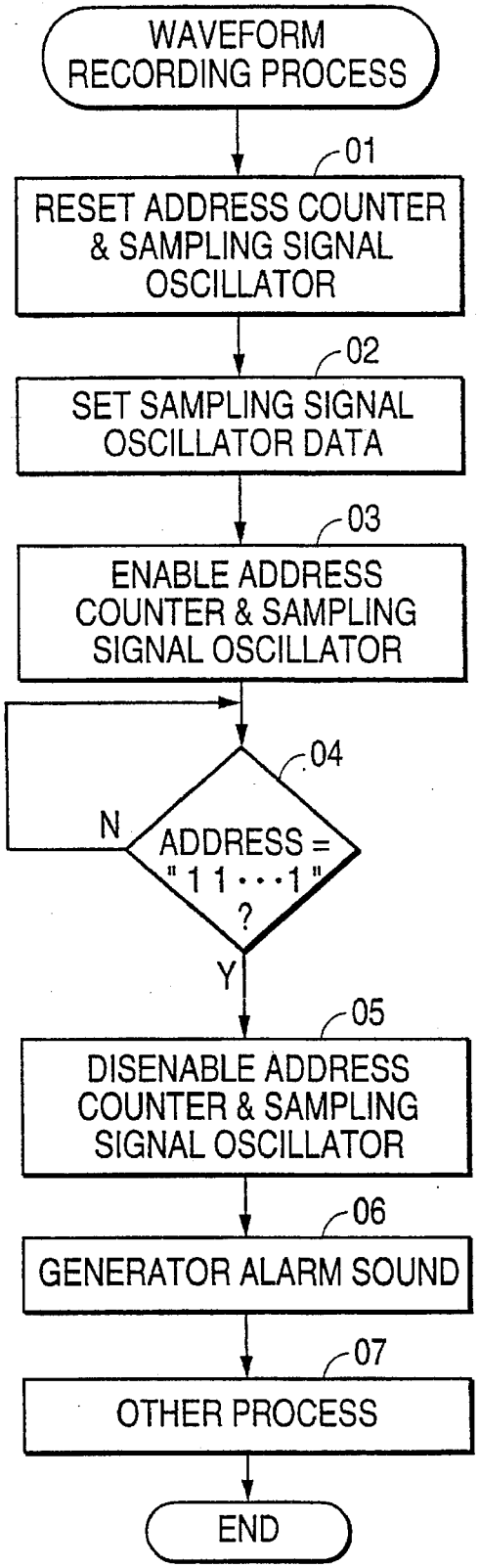
FIG. 4 is a flow chart illustrating a waveform recording process on sound signal SS.

FIG. 4 is a flow chart showing a waveform recording process which is executed by the CPU 10. The process is started when the operator initiates the recording of sound waveform by key operating on the keyboard 13. The key operation is to operate a particular key, for instance input a command "RECORDING START" and then operate an ENTER key. In this case, the operator effects the command by directing the microphone 1 toward a source of sound, which is to be recorded. The sampling sound source may be artificial sounds not electronically controlled, for instance sounds of acoustic musical instruments, natural sounds, for instance cries and calls of animals, reproduced sound signals from analog recorders, and electronically controlled sounds, for instance reproduced digital sound signals from compact disks and sound data from other electronic musical instruments.

In the waveform recording process, first the address counter 9 and sampling signal oscillator 8 are reset (step 01), then programmable data for determining the frequency of the sampling signal SP is set in the sampling signal oscillator 8 (step 02), and then the address counter 9 and sampling signal oscillator 8 are enabled (step 03). As a result, the sampling sisal SP, which is a clock signal having a fixed frequency, is output from the sampling signal oscillator 8, the latch 4 latches the sampling signal SP for every cycle thereof, and a write command signal is supplied to the first waveform RAM 5 for every cycle of the sampling signal SP. Thus, sound data SD, obtained with the sampling of the sound signal SS, is written successively in the first waveform RAM 5.

The process of the sampling recording of the sound signal SS is repeatedly executed until the address data in the address counter 9 is "11 . . . 1" (step 04). When the address data in the address counter 9 is "11 . . . 1", the address counter 9 and sampling signal oscillator 8 are disabled to discontinue their operation (step 05). Then, sound information for an alarm sound is set in the tone generator 21, and the alarm sound is generated from the sounding system 22 (step 06). Thus, the operator is notified of the end of the sampling recording of the sound signal SS. Afterwards, other processes are executed (step 07) to bring an end to the waveform recording process.

After the sound signal SS has been recorded in the above way, the operator inputs a command for reading out and displaying the sound data SD to the keyboard 13. As a result, the sound data SD having been recorded in the first waveform RAM 5 is sequentially read out and displayed on the CRT 15 and, if necessary, printed in the printer 18. Thus, the sound signal SS is displayed by simulation display with a group of dots, which represents the magnitude of the level of the sound data SD at each point thereof, as shown in (1) in FIG. 8.

Meanwhile, the operator inputs a command for displaying a vertical cursor to the keyboard 13, thus displaying the vertical cursor. The operator then moves the cursor using a mouse or the like to the clear point CP in the start portion of the sound data SD and then depresses the ENTER key. As a result, the CPU 10 starts a waveform modification process, which as will be described later. In this case, it is possible to display the start portion of the sound data SD by on an enlarged-scale display on the CRT 15 or use a write pen or other means to input the clear point. Further, the clear point CP may be fixed data stored in the ROM 11 or the control RAM 7.

5. Waveform Modification Process

Figure 5:
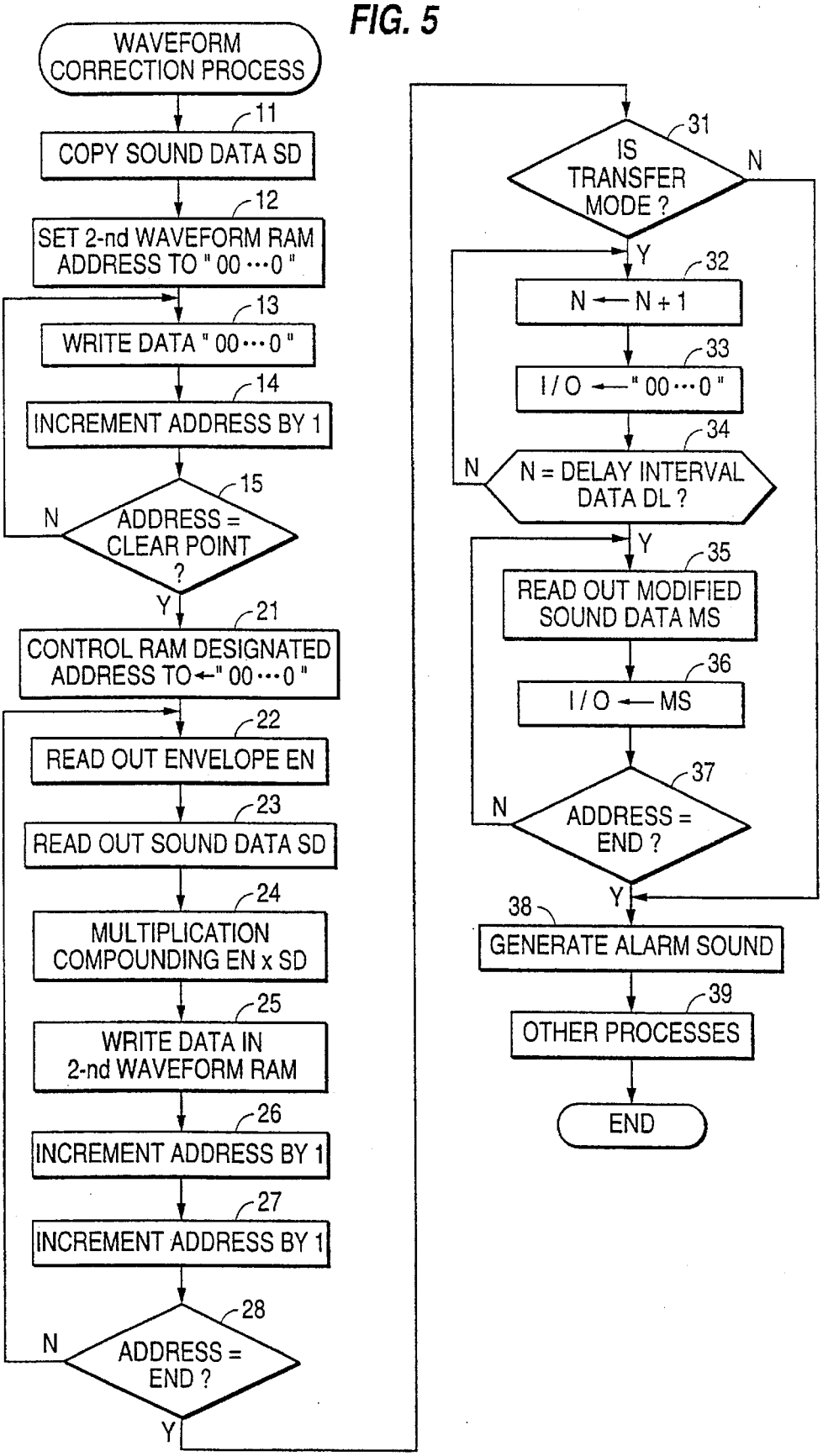
FIG. 5 is a flow chart illustrating a waveform modification process on sound data SD.

FIG. 5 is a flow chart showing a waveform modification process which is executed by the CPU 10. The process is started when the operator operates the keys of keyboard 13 and commands the modification of the sampling recorded sound signal SS. The command may be given by operating a particular key, for instance inputting a command "MODIFY WAVEFORM", and then operating the ENTER key.

In the waveform modification process, the sound data SD in the first waveform RAM 5 is copied in the second waveform RAM 6 (step 11) as well. It is possible as well to execute the waveform modification process directly on the sound data SD in the first waveform RAM 5. Subsequently, the designated address in the second waveform RAM 6 is set to "00 . . . 0" (step 12). Then, data "00 . . . 0" is written in the address "00 . . . 0" of the second waveform RAM 6, and the sound data SD is cleared (step 13). Then, the designated address data is incremented by "+1" (step 14). The process of clearing the first portion of sound data SD in the steps 13 and 14, is executed until the designated address data reaches the clear point data CP (step 15).

The sound data SD from the start thereof to the clear point CP is all cleared, thus clearing noise data NS in the start portion. The sound data SD after this clearing is shown in (2) in FIG. 6. It is possible to replace step 13 with a step of reading out envelope data EN of level "0" and multiplying compound the sound data SD with the read-out data.

If the clear point CP of the sound data SD designated by the vertical cursor noted above is a zero-crossing point, at which the level of the data SD is "0", the waveform modification process may terminate at step 15, thereby omitting steps 21 through 28.

The designated address of the control RAM 7 is then set to "00 . . . 0" (step 21), the envelope data EN in this address "00 . . . 0" of the control RAM 7 is read out (step 22), and the sound data SD in the designated address of the second waveform RAM 6, i.e., at the clear point CP, is read out (step 23). The read-out envelope data EN and sound data SD are multiplied (step 24), and the multiplied data is written in the designated address of the second waveform RAM 6 (step 25).

Subsequently, the designated address of the control RAM 7 is incremented by "+1" (step 26), and also the designated address of the second waveform RAM 6 is incremented by "+1" (step 27). The multiplication of the sound data SD in steps 22 through 27, is executed repeatedly until the end of the envelope data EN (step 28).

At the clear point CP of the sound data SD envelope data EN of level "0" is multiplied by a discontinuous portion of data suddenly rising from "0" to a certain level. Thus, the clear point CP of the sound data SD is modified to level "0". Subsequent to the clear point CP of the sound data SD, multiplication is effected with envelope data EN, the level of which is gradually increased from "0". This has an effect of eliminating the discontinuous portion at the clear point CP of the sound data SD as shown in (3) in FIG. 6, thus obtaining modified sound data MS starting smoothly, that is, removing noise in the start portion of the sound data SD.

Afterwards, a check is done as to whether a mode of transfer of the above modified sound data MS has been established (step 31). If this mode has been established, a number of pieces of data "00 . . . 0" corresponding to the delay interval data DL are transferred to the interface 12 (steps 32 to 34). Then the modified sound data MS is read out from the address of the second waveform RAM 6 corresponding to the clear point data CP (step 35) and transferred to the interface 12 (step 36). This process of reading and transferring data is executed repeatedly until the last address of the second waveform RAM 6 (step 37).

Steps 31 through 37 may be executed separately from steps 11 through 15 and 21 through 28. In this case, the transfer of the sound data SD is directed via the keyboard 13, and steps 31 through 37 is executed. Finally, alarm sound information is set in the tone generator 21, and the alarm sound is generated by the sounding system 22 (step 38). Thus, the operator knows that the modification of the sound data SD has been completed. Subsequently, other processes are executed (step 39) to terminate the waveform modification process.

The above embodiment of the invention is by no means limitative, and various changes and modifications are possible without departing from the scope and spirit of the invention. For example, the address data that is detected in the steps 04, 28 and 37 may be other than the end addresses of the first and second waveform RAMs 5 and 6 and control RAM 7 so long as it is end address data of areas, in which the sound data SD, envelope data EN and modified sound data MS are stored. Further, the process of clearing the start portion of the sound data SD and multiplying the remainder data with the envelope data EN, may be adopted for removing specific data from the sound data SD rather than the removal of the noise data NS.

Further, while the envelope data EN is stored and read out in the above embodiment, it is possible as well to generate envelope data by operation based on a specific formula of operation. The operation formula may be an exponential fraction, a logarithmic fraction, a linear fraction, a quadratic fraction, a hyperbolic function, a trigonometric fraction, etc., and it is for modifying the sound data SD from the clear point CP to the hold point HL to 0 to 1 time. Further, the sampling recording means constituted by the microphone 1, amplifier 2, A/D converter 3, latch 4, first waveform RAM 5, sampling signal oscillator 8 and address counter 9 is by no means limitative, and it is possible to use any means which permits sampling recording.

Further, in the multiplication of the sound data SD and envelope data EN, the start of the envelope data EN and the clear point CP of the sound data SD need not be coincident but may be slightly deviated from each other. Further, the value of the start of the envelope data EN need not be "0" so long as it is sufficiently small for the removal of noise at the discontinuous point.

What is claimed:

1. An apparatus for sound recording in an electronic sound control system comprising:

sampling means for sampling an input sound signal;

sound data recording means for recording entire sampled sound data from said sampling means;

clearing means for clearing a start portion of the entire sampled sound data recorded in said sound data recording means to produce a cleared portion and a discontinuous portion of the entire sampled sound data;

modifying data storage means for storing modifying data for gradually increasing a level of the discontinuous portion of the entire sampled sound data from level "0";

modifying data reading means for reading the modifying data from said modifying data storage means;

modifying means for modifying the discontinuous portion of the entire sampled sound data such that the level of the discontinuous portion increases from "0" to a level of a first sample of the entire sampled sound data immediately following the cleared portion, as modified according to the modifying data read out by said modifying data reading means, to produce a continuous portion; and modified sound data storing means for storing the cleared portion, the continuous portion and a remainder of the entire sampled sound data, as modified sound data.

2. The apparatus of claim 1, further comprising modified sound data storing means for storing the sampled sound data as modified by said modifying means.

3. The apparatus of claim 1, wherein said clearing means includes designating means for designating the start portion to be cleared of the sampled sound data recorded in said sound data recording means and clearing means for clearing the start portion of the entire sampled sound data.

4. The apparatus of claim 1, wherein the modified entire sampled sound data in said modifying means is supplied to a stereo system as a sound source.

5. The apparatus of claim 1, wherein said modifying data storage means stores modification envelope data for gradually increasing the level of the discontinuous portion from level "0", and said modifying means multiplies said modification envelope data by the entire sampled sound data after said discontinuous portion.

6. The apparatus of claim 1, wherein said modifying data storage means stores an operation formula for varying an input value from zero time to one time, and said modifying means modifies said discontinuous portion of the entire sampled sound data.

7. The apparatus of claim 1, further comprising storage means for storing the entire sampled sound data obtained after said discontinuous portion.

8. A method of sound recording in an electronic sound control system comprising the steps of:

(A) sampling an input sound signal;

(B) recording entire sampled sound data obtained in said step (A);

(C) clearing a start portion of the entire sampled sound data recorded in said step (B) to produce a cleared portion and a discontinuous portion of the entire sampled sound data;

(D) storing modifying data for gradually increasing a level of the discontinuous portion of the entire sampled sound data from level "0";

(E) reading the modifying data stored in said step (D);

(F) modifying the discontinuous portion of the entire sampled sound data of said step (C) such that the level of the discontinuous portion increases from "0" to a certain level according to the modifying data read out in said step (E) to produce a continuous portion; and (G) storing the cleared portion, the continuous portion and a remainder of the entire sampled sound data, as modified sound data.

9. The method of claim 8, wherein said step (C) comprises:

(C) (1) designating the start portion of the entire sampled sound data recorded in said step (B); and (C) (2) clearing the start portion of the entire sampled sound data.

10. The method of claim 8, wherein the modified entire sampled sound data obtained in said step (F) is used as a sound source of a stereo system.

11. The method of claim 8, wherein in said step (D) modification envelope data for gradually increasing the level of said discontinuous portion from level "0" is stored, and in said step (F) said modification envelope data is multiplied by the entire sampled sound data after said discontinuous portion.

12. The method of claim 8, wherein in said step (D) a formula for varying an input value from zero time to one time is stored, and in said step (F) modifying said discontinuous portion of the entire sampled sound data is performed based on said formula.

13. The method of claim 8, wherein said step (G) comprises storing the modified sound data in means for storing.

14. A method of making a sound recording, comprising the steps of:

(A) sampling an input sound signal;

(B) recording entire sampled sound data obtained in said step (A);

(C) clearing a start portion of the entire sampled sound data recorded in said step (B) to produce a cleared portion and a discontinuous portion of the entire sampled sound data;

(D) storing modifying data for gradually increasing a level of the discontinuous portion of the entire sampled sound data from level "0";

(E) reading the modifying data stored in said step (D);

(F) modifying the discontinuous portion of the entire sampled sound data of said step (C) such that a level of the discontinuous portion increases from "0" to a level of a first sample of the entire sampled sound data immediately following the discontinuous portion, as modified according to the modifying data read out in said step (E), to produce a continuous portion; and (G) storing the cleared portion, the continuous portion and a remainder of the entire sampled sound data, as modified sound data.

15. The method of claim 14, wherein said step (C) includes the sub-steps of:

(C)(1) designating the start portion of the entire sampled sound data recorded in said sound data recording means, and (C)(2) clearing the start portion of the entire sampled sound data.

16. The method of claim 14, wherein the modified sound data obtained in said step (F) is supplied as a sound source of a stereo system.

17. The method of claim 14, wherein in said step (D) modification envelope data for gradually increasing the level of the discontinuous portion from level "0" is stored, and in said step (F) said modification envelope data is multiplied by the entire sampled sound data.

18. The method of claim 14, wherein in said step (D) a formula for varying an input value from zero time to a first time is stored, and in said step (F) modifying the discontinuous portion of the entire sampled sound data is performed based on the formula.

* * * * *